United States Patent [19]

Okada et al.

[11] 4,430,598

[45] Feb. 7, 1984

[54] FLUORESCENT DISPLAY TUBE

[75] Inventors: Toshio Okada; Katsumi Motoyama; Takashi Yoshii, all of Izumi, Japan

[73] Assignee: Nippon Electric Co., Ltd., Tokyo, Japan

[21] Appl. No.: 276,741

[22] Filed: Jun. 24, 1981

[30] Foreign Application Priority Data

Jun. 24, 1980 [JP] Japan ..... 55-88241[U]

[51] Int. Cl.[3] ..... H01J 1/62; H01J 63/04

[52] U.S. Cl. ..... 313/497; 313/495; 313/513; 313/483

[58] Field of Search ..... 313/497, 517, 519, 496, 313/489, 513, 510, 117, 495, 483

[56] References Cited

U.S. PATENT DOCUMENTS

| | | | |
|---|---|---|---|
| 3,327,154 | 6/1967 | Bowerman | 313/188 |
| 3,500,392 | 3/1970 | Maljuk et al. | 361/433 |
| 4,041,348 | 8/1977 | Eto et al. | 313/497 |

*Primary Examiner*—David K. Moore
*Assistant Examiner*—K. Wieder
*Attorney, Agent, or Firm*—Sughrue, Mion, Zinn, Macpeak and Seas

[57] ABSTRACT

A fluorescent display having improved readability in bright light and reduced visibility of internal connecting components and wiring is provided by placing the anode segments on a first background having a color similar to that of the unilluminated segments and the connecting components and wiring on a second background surrounding the first and having a color similar to that of said components and wiring.

7 Claims, 3 Drawing Figures

FLUORESCENT DISPLAY TUBE

The present invention relates to fluorescent display tubes, and more particularly to fluorescent display tubes with an improved display quality in a bright environment.

Recently, fluorescent display tubes for displaying numerals and symbols have become popular have and come to be used for multiple purposes in such environments as out-of-doors or in highly luminous surroundings. The conventional type fluorescent display tubes had a deeply black colored insulating material coated over the whole surface of the anode substrate except for display segments for improving the contrast between the anode plate and luminous display segments. This automatically intensified the contrast with the non-luminous segments. Because the fluorescent material which emits blue-green color is white colored when it is not emitting light, the contrast between the luminous segment and the non-luminous segment becomes deteriorated under a highly luminous light, thus causing errors in reading.

A proposal has been made to cope with above-mentioned defects by coating the whole surface of the substrate with a white colored insulating material having the same color tone as the fluorescent material of ZnO:Zn which emits a green colored light. Although such conventional approach eliminates errors in reading, it also lowers the display quality as discussed hereinbelow. Of the component elements of a fluorescent display tube, lead electrodes within the tube are usually dull finished to prevent a reflection of external light with a color of dark green. Thus the lead electrodes make a clear contrast against the white colored substrate. Therefore, the inside structure becomes markedly visible against the display face and presents rather unattractive sight.

An object of the present invention is to offer a fluorescent display tube which enables a superior quality display even in a highly luminous environment.

According to the present invention, the color tone of the insulating layer on the anode substrate is divided into two, parts the first color being made the same group as that of the fluorescent material and limited to the corresponding region inside the grid frame, while the second color is made the color of the same group as that of the conspicuous electrode component within the tube and is provided in the remaining region.

DETAILED DESCRIPTION OF THE PREFERRED EMBODIMENTS

Figure 1:
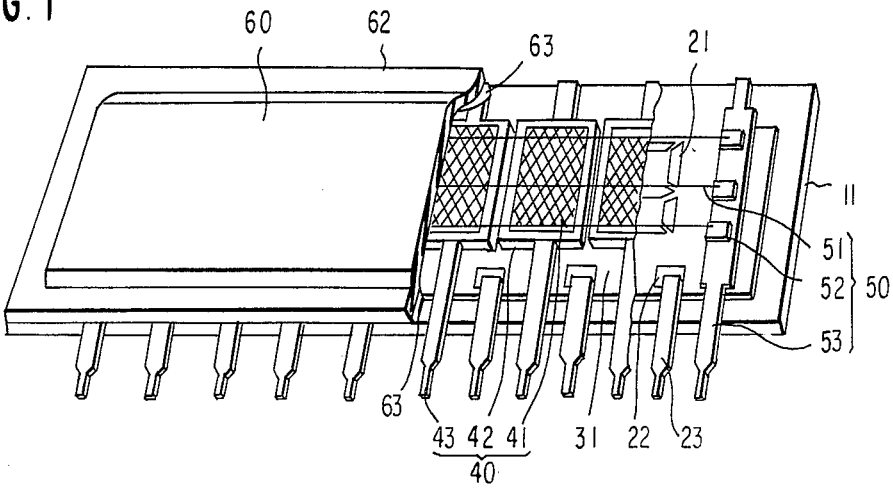
FIG. 1 (PRIOR ART)
FIG. 1 is a perspective view showing a conventional fluorescent display tube.

Referring to FIG. 1, in one example of a conventional fluorescent display tube as indicated in U.S. Pat. No. 4,041,348, there are formed anode segments 21 coated with fluorescent material and anode terminals; 22 connected to the common anode segments for respective digits through printed wirings (not shown) on an insulating substrate 11. An insulating film 31 is coated on the substrate 11 except for the regions of the segments 21, terminals 22 and sealing portions thereby making the printed wirings invisible. This insulating film 31 shows a deep-black or white color. Grid electrodes 40 comprise mesh members 41, frame members 42 and grid leads 43. A pair of cathodes 50 are provided at both ends of the anode substrate 11 coated with the insulating film 31. The cathode 50 comprises filaments 51, filament support members 52 and cathode leads 53. Anode leads 23 are connected to the anode terminals 22. A flange portion 62 of a glass cover 60 and the substrate 11 are sealed by a frit glass 63, and thereby fixing the leads sandwiched between the glass cover 60 and the anode substrate 11.

In a conventional fluorescent display tube as above depicted, since an insulating film 31 extends outside the grid frame 42 and covers entire area viewed from a display window, the grid leads 43, the anode terminals 22 and the anode leads 23 are excessively visible against the insulating film 31 when it is white colored, thus deteriorating the display quality.

Figure 2:
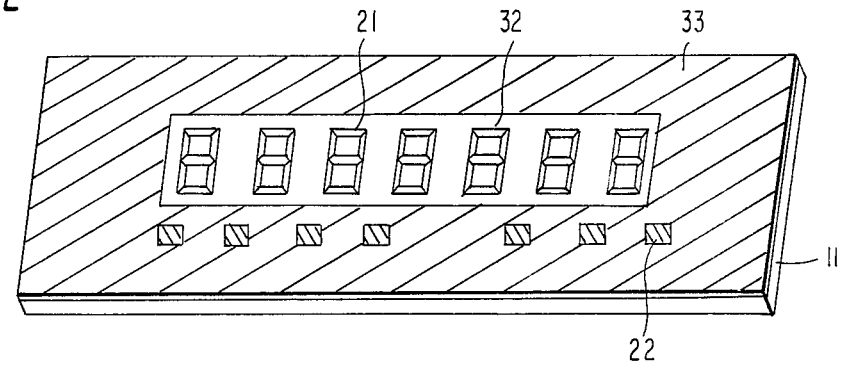
FIG. 2 is a perspective view of an anode substrate to explain one embodiment of the present invention.

According to one embodiment of the present invention, the insulating film on the insulating substrate 11 is divided into two regions as shown in FIG. 2; the outer periphery of the white colored insulating film 32 coated around the circumference of the anode segments 21 provided with ZnO:Zn fluorescent material is so defined as not to extend beyond the external envelope curve region of the grid frames. A deep-black colored insulating film 33 is coated around the white colored insulating film 32. In FIG. 2, the black colored film 33 has a plurality of openings to expose the anode terminals 22, while a white colored film 32 has a plurality of openings to expose the anode segments 21. Although the black colored film 33 is extended to end portions of the substrate 11, it is possible to terminate it within a sealing portion.

Figure 3:
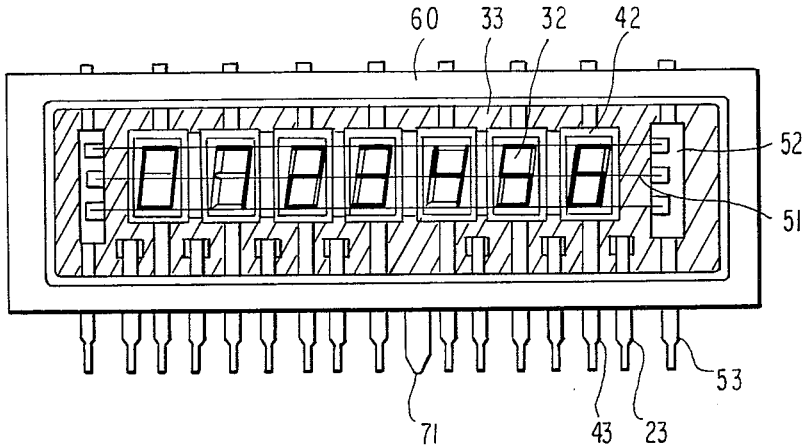
FIG. 3 is a plane view showing one embodiment of the present invention employing the anode substrate shown in FIG. 2.

FIG. 3 is a plane view of such an anode substrate completed by fixing the respective electrodes and the glass cover. In FIG. 3, it is illustrated that a fluorescent display tube has a structure of seven digits displaying numerals zero through six. In FIG. 3, for the purpose of simplification, the mesh member of the grid is eliminated. The other members corresponding to those in FIG. 1 are denoted by identical numbers. The indicated reference numeral 71 denotes an exhaust pipe. Two different colored areas are easily obtained by coating a black colored insulating film on a substrate as shown in FIG. 1, and successively coating a white colored insulating film 32 on the black colored insulating film in a predetermined pattern as shown in FIG. 2.

As is clear from FIG. 3, it is hardly possible to read the display of zero as eight since the contrast of the non-luminuous segment and the surrounding bright insulating material 32 is not so striking. On the other hand, since the color of the inner electrode such as grid is dark green, it becomes blurry against the dark insulating material 33, thereby eliminating a view of complex electrode structure in the display window. Thus, it is possible to obtain a fluorescent display tube of a superior quality display.

Representative examples of the luminscent colors presently used in the fluorescent material are ZnO:Zn for a blue green emission, $SnO_2$:Eu for an amber emission and (Zn, Cd)S:Ag for a red emission, which respectively assume white, pale yellow and orange when not emitting light. Although it is preferably to match the color of the inner insulating material 32 disposed around the segment electrodes to that of the fluorescent material when not emitting light, it is also possible to use the cream color insulating material common to the above-mentioned three types of fluorescent materials. In the case of multi-colored fluorescent display tubes in particular, this proves advantageous especially cost-wise since only one step is needed for forming the inner insulating material 32, and because only one type of inner insulating material 32 is used.

The dark insulating layer 33 is formed as in the prior art by mixing iron oxide or chromium oxide with frit glass, preparing it in a paste form by means of a solvent, and subjecting it to a conventional screen printing method. On the other hand, electrodes such as grid may be colored lusterless dark green by subjecting it to a heat treatment in a wet hydrogen furnace at 1,050° C. for 10 minutes. For coloring the insulating film, a pigment is added to obtain a desired color. For instance, when fluorescent material of ZnO:Zn type is used to emit blue green, aluminium oxide or titanium oxide is mixed as a white pigment in frit glass, and the resultant mixture is prepared into a paste by using a solvent or the like, and is subjected to the screen printing method.

When fluorescent material of $SnO_2$:Eu type is used as the amber color emitting, cadmium sulfide is mixed as a yellow pigment with frit glass.

When fluorescent material of (Zn, Cd)S:Ag type is used as the red color emitting, manganese oxide is mixed as a cream pigment with frit glass.

FIGS. 2 and 3 show an example where the external leads for the grid and the filament are integrally formed with the internal electrode and interposed between the substrate and the glass cover. This invention is applicable not only to this example but also to the fluorescent display tube of a type where the external lead and the internal electrode are separatly formed and they are connected each other outside of the sealed portion as described in U.S. Pat. No. 4,035,885. in the latter type fluorescent display tube, a bright colored insulating film has a plurality of openings corresponding to anode segments while a dark colored insulating film has a plurality of openings corresponding to grid and cathode terminals for electrically connecting grid and cathode electrodes and printed wirings extending outside of sealed portion. The printed wirings for supplying the power to the anode segments, the grids and the cathodes are covered by insulating films, and the support members for the grids and the cathodes are fixed to the substrate by a black colored conductive adhesive agent to connect with the terminals of printed wirings. The present invention enables obliteration of the view of the black conductive adhesive agent or the inner electrodes in the display window.

As discussed heretofore, because of a rather dull contrast between the non-luminous segment and the surrounding substrate surface, the non-luminous segment does not become conspicuous against the substrate surface even under a bright light such as the direct sun ray. Thus, the invention brings about a remarkable effect to the observer who sees only the segment which is emitting the light. It also differs an extremely high quality display where the complex electrode structure which might otherwise hinder the vision is submerged in the background because of the dull contrast between the inner electrodes and the substrate surface.

Accordingly, the present invention is further advantageous in that readability in a highly luminous circumstance is radically improved thus achieving an excellent display quality.

We claim:

1. A fluorescent display tube comprising:

a hermetically sealed casing having a substrate and a transparent window opposing each other, said substrate having different colored first and second background regions on its surface opposing said window, said first background region being surrounded by said second background region, a filament disposed between said substrate and window, a grid disposed between said substrate and filament, said grid having a mesh portion opposing said first background region, a plurality of anode segments provided within said first background region and opposing said mesh portion, a layer of a fluorescent material provided on each of said anode segments and having a color similar to that of said first background region, external electrodes fixed to said casing, and lead means for electrically connecting said filament, grid and anode segments to said external electrodes, the exposed portions of said lead means being located on said second background region and having a color similar to that of said second background region, whereby the readability of the displayed information in a bright environment is improved and the exposed portion of said lead means is indistinct against said second background region and thus achieving an excellent display quality.

2. A fluorescent display tube as claimed in claim 1, in which said first background region has a whitish color while said second background region has a dark color.

3. A fluorescent display tube as claimed in claim 1, in which said second background region is made of a dark insulating film coated on said substrate except for said anode segments, and said first background region is made of a whitish insulating film selectively coated on said dark insulating film, the exposed portions of said lead means including supporting means for said filament and grid respectively provided on said dark insulating film, said lead means further including concealed portion provided under said dark insulating film, and said exposed portion of said lead means being dull finished.

4. A fluorescent display tube comprising:

an insulating substrate and an upper cover connected to each other through a seal portion therebetween thereby forming a casing said cover having a transparent window, a plurality of groups of anode segments provided on said insulating substrate, each group having a predetermined display pattern, a layer of a fluorescent material provided on each of said anode segments, a grid disposed above each group of said anode segments and having a respective mesh portion of an area to cover each group of said anode segments, each of said grid having a lead portion observed from the transparent window of said cover, a filament disposed above said grid, a first insulating film provided on said insulating substrate surrounding said anode segments thereby forming a first background region against information displayed by luminuous segments among said anode segments, said first insulating film having a first color tone similar to that of said fluorescent material itself thereby reducing contrast between said first insulating film and non-luminous anode segments, a second insulating film provided on said insulating substrate surrounding said first insulating film thereby forming a second background region against said first background region and said lead portions of said grid, said second insulating film having a color tone distinctively different from said first color tone and similar to that of said lead portions of said grid thereby reducing contrast between said second insulating film and said lead portions.

5. A mult-figure fluorescent display tube comprising:

an insulating substrate and an upper cover connected to each other through a seal portion therebetween thereby forming a casing, an array of groups of anode segments provided on said substrate, each group having a predetermined display pattern, a plurality of dark colored anode terminals provided on said substrate, a plurality of wirings provided on said substrate for electrical connections between said anode segments and terminals, A dark colored insulating film coated on said substrate except for said anode segments and terminals thereby concealing said wirings, a whitish colored insulating film selectively coated on said dark colored insulating film and surrounding only an array of said display pattern thereby forming an elongated whitish region, a layer of a fluorescent material provided on each of said anode segments, said fluorescent material having a color tone similar to that of said elongated whitish region, a mesh grid disposed above each group of said anode segments thereby forming an elongated array of mesh grids covering said enlongated whitish region, a dark colored grid lead connected to each of said mesh grid for supporting said mesh grid, said dark colored anode terminals and said dark colored grid leads being disposed on said dark colored insulating film.

6. A multi-figure fluorescent display tube as claimed in claim 5, in which said dark colored insulating film is formed by mixing iron oxide or chromium oxide with frit glass, and said whitish colored insulating film is formed by mixing aluminum oxide or titanium oxide with frit glass, the leads of said grid, filament and anode being colored with lusterless dark green.

7. A multi-figure fluorescent display tube as claimed in claim 5, in which said whitish colored insulating film is divided into a plurality of regions having different colors and said fluorescent material has different colors corresponding to said divided whitish colored insulating film, whereby the information is displayed with a different color.

* * * * *

UNITED STATES PATENT AND TRADEMARK OFFICE

CERTIFICATE OF CORRECTION

PATENT NO. : 4,430,598

DATED : February 7, 1984

INVENTOR(S) : Toshio OKADA et al.

It is certified that error appears in the above-identified patent and that said Letters Patent is hereby corrected as shown below:

Col. 1, line 37, after "presents", insert -- a --;
line 44, after "two", delete the "," and after "parts", insert a -- , --;
line 65, after "terminals", change the ";" to -- , --.

Col. 2, line 17, after "covers", insert -- the --;
line 67, after "is", change "preferably" to -- preferable --.

Col. 3, line 39, before "the", change "in" to -- In --;
line 62, after "also", change "differs" to -- offers --.

Col. 5, line 12, after "A", change "mult-figure" to -- multi-figure --.

Signed and Sealed this

Twenty-ninth Day of May 1984

[SEAL]

Attest:

GERALD J. MOSSINGHOFF

Attesting Officer

Commissioner of Patents and Trademarks